US011095070B2

(12) United States Patent
Ishikawa et al.

(10) Patent No.: US 11,095,070 B2
(45) Date of Patent: Aug. 17, 2021

(54) ELECTRICAL CONNECTOR

(71) Applicant: J.S.T. Mfg. Co., Ltd., Tokyo (JP)

(72) Inventors: Takahiro Ishikawa, Osaka (JP); Masaaki Ishigami, Osaka (JP); Kensuke Takahashi, Osaka (JP)

(73) Assignee: J.S.T. MFG. CO., LTD., Osaka (JP)

( * ) Notice: Subject to any disclaimer, the term of this patent is extended or adjusted under 35 U.S.C. 154(b) by 0 days.

(21) Appl. No.: 16/855,457

(22) Filed: Apr. 22, 2020

(65) Prior Publication Data

US 2020/0343669 A1 Oct. 29, 2020

(30) Foreign Application Priority Data

Apr. 26, 2019 (JP) ..... JP2019-086646

(51) Int. Cl.
*H01R 13/506* (2006.01)
*H01R 13/58* (2006.01)
*H01R 4/48* (2006.01)

(52) U.S. Cl.
CPC ..... *H01R 13/582* (2013.01); *H01R 13/506* (2013.01); *H01R 4/4818* (2013.01)

(58) Field of Classification Search
CPC .. H01R 13/582; H01R 4/4818; H01R 13/506; H01R 13/5833; H01R 13/5841; Y10S 439/902
See application file for complete search history.

(56) References Cited

U.S. PATENT DOCUMENTS 5,560,981 A * 10/1996 Ito ..... H01R 13/405 428/209
6,325,661 B1 * 12/2001 Tabata ..... H01R 13/5205 439/459
7,285,011 B2 * 10/2007 Hardy ..... H01R 13/506 439/582
9,263,826 B2 * 2/2016 Wu ..... H01R 13/567
9,401,563 B2 * 7/2016 Simpson ..... H01R 13/5841
9,728,890 B2 * 8/2017 Nakai ..... H01R 13/5202
2003/0109169 A1 * 6/2003 Ushiro ..... H01R 13/5816 439/468
2005/0003699 A1 * 1/2005 Fukui ..... H01R 13/562 439/473

(Continued)

FOREIGN PATENT DOCUMENTS

GB 2516555 A 1/2015
JP 2015-011990 A 1/2015
WO WO-2013174979 A1 * 11/2013 ..... H01R 13/502

*Primary Examiner* — Tho D Ta
(74) *Attorney, Agent, or Firm* — Kratz, Quintos & Hanson, LLP

(57) ABSTRACT

An object of the invention is to suppress rotation around the axis of a tip part of a single wire and to suppress removal of the single wire from a housing. An electrical connector 1 according to the invention includes a housing 2; a terminal 3 to which a single wire W is to be connected; and a holding member 4, wherein the holding member 4 has a leading-out part 44 to lead out the single wire W from the inside to the outside of the housing 2, and the leading-out part 44 is configured to lead out the single wire W being bent and extending in a given extending direction so as to cross the axis X direction of a tip part W11 of the single wire W connected to a single wire connecting part 32.

8 Claims, 10 Drawing Sheets

(56) References Cited

U.S. PATENT DOCUMENTS

| | | | | |
|---|---|---|---|---|
| 2006/0172612 | A1* | 8/2006 | Wasalaski | H01R 13/506 439/752 |
| 2008/0108246 | A1* | 5/2008 | Landis | H01R 4/26 439/464 |
| 2010/0173531 | A1* | 7/2010 | Holste | H01R 4/4836 439/700 |
| 2015/0064973 | A1* | 3/2015 | Wu | H01R 13/56 439/626 |
| 2015/0311604 | A1* | 10/2015 | France | H01R 4/4818 439/625 |

* cited by examiner

ELECTRICAL CONNECTOR

TECHNICAL FIELD

The present invention relates to an electrical connector.

BACKGROUND OF THE INVENTION

An electrical connector is used at the time of electrically connecting electric wires to each other or an electric wire to a substrate. Such an electrical connector has a housing having terminals and electric wires to be connected to the terminal. As the electric wire for use in the electrical connector, a single wire and a stranded wire are used.

Of these, the single wire is made up of one conductor, and a coating to coat the conductor. At a tip part of the single wire, the coating is removed to expose the outer periphery of the conductor. For example, as shown in JP 2015-011990 A, the conductor being exposed at the tip part of the single wire is held between a pair of leaf spring-shaped connecting pieces to electrically connect the terminal of the electrical connector with the single wire.

SUMMARY OF THE INVENTION

Unlike a stranded wire, a single wire for use in an electrical connector is made up of one conductor being relatively thick and has high rigidity. Therefore, when a rotational force is applied around the axis of the single wire, for example, before or after the electrical connector is assembled into a counterpart connector, a coating portion of the single wire and a part of the conductor, which is connected to a terminal of the single wire, are not twisted around the axis like the stranded wire, but both rotate together around the axis.

In this way, when the rotational force is applied around the axis of the conductor in a connecting part between the conductor of the single wire and a terminal of a housing, the conductor being held between terminals rotates with respect to the terminal of the housing to be easily pulled out from the housing.

Then, in view of such problems, an object of the present invention is to provide an electrical connector that makes it possible to suppress rotation around the axis of a tip part of a single wire connected to a single wire connecting part of a terminal of the electrical connector and to suppress removal of the single wire from a housing.

An electrical connector according to the present invention is an electrical connector, to which a single wire is to be connected, the electrical connector to be electrically connected to a counterpart connector, and the electrical connector comprising: a housing a terminal to which the single wire is to be connected, the terminal being provided in the housing; and a holding member for holding the single wire in a given extending direction, the holding member being mounted to an end part of the housing, the end part being on a side of the housing at which the single wire is connected, wherein the terminal has a single wire insertion part having an inserting port into which a tip part of the single wire is inserted; a single wire connecting part to be electrically connected to the tip part of the single wire; and a counterpart terminal connecting part to be electrically connected to a counterpart terminal of the counterpart connector; the holding member and/or the housing has a leading-out part to lead out the single wire from an inside of the housing to an outside of the housing; and the leading-out part is configured to lead out the single wire being bent and extending in the given extending direction so as to cross an axis direction of the tip part of the single wire connected to the single wire connecting part.

Moreover, the leading-out part preferably has a pair of wall parts to abut against the single wire such that the tip part of the single wire does not rotate around the axis of the tip part.

Furthermore, the single wire connecting part preferably comprises a pair of contact spring parts pinching the tip part of the single wire from both sides of the single wire.

Moreover, the holding member preferably has an engaging part to engage with an engaged part provided on a side face of the housing, and the engaging part is provided at a position being adjacent to the leading-out part.

Furthermore, the holding member preferably has a pressing face extending in a direction being perpendicular to the axis direction of the tip part of the single wire.

Moreover, the holding member and/or the housing further preferably has a second leading-out part, and in a case that the single wire is bent in a second direction other than the extending direction of the single wire being led out in the leading-out part, the second leading-out part is configured to lead out the single wire in the second direction.

Furthermore, preferably, the holding member further has a third leading-out part, and in a case that the single wire extends along the axis direction of the tip part of the single wire, the third leading-out part is configured to lead out the single wire in the axis direction of the tip part of the single wire.

The electrical connector according to the present invention makes it possible to suppress rotation around the axis of a tip part of a single wire connected to a single wire connecting part of a terminal of the electrical connector and to suppress removal of the single wire from a housing.

DETAILED DESCRIPTION

Below, an Embodiment of an electrical connector according to the present invention is described with reference to the drawings. The Embodiment shown below is merely exemplary, so that the electrical connector according to the present invention is construed to be not limited to the below-described Embodiment.

Figure 1:
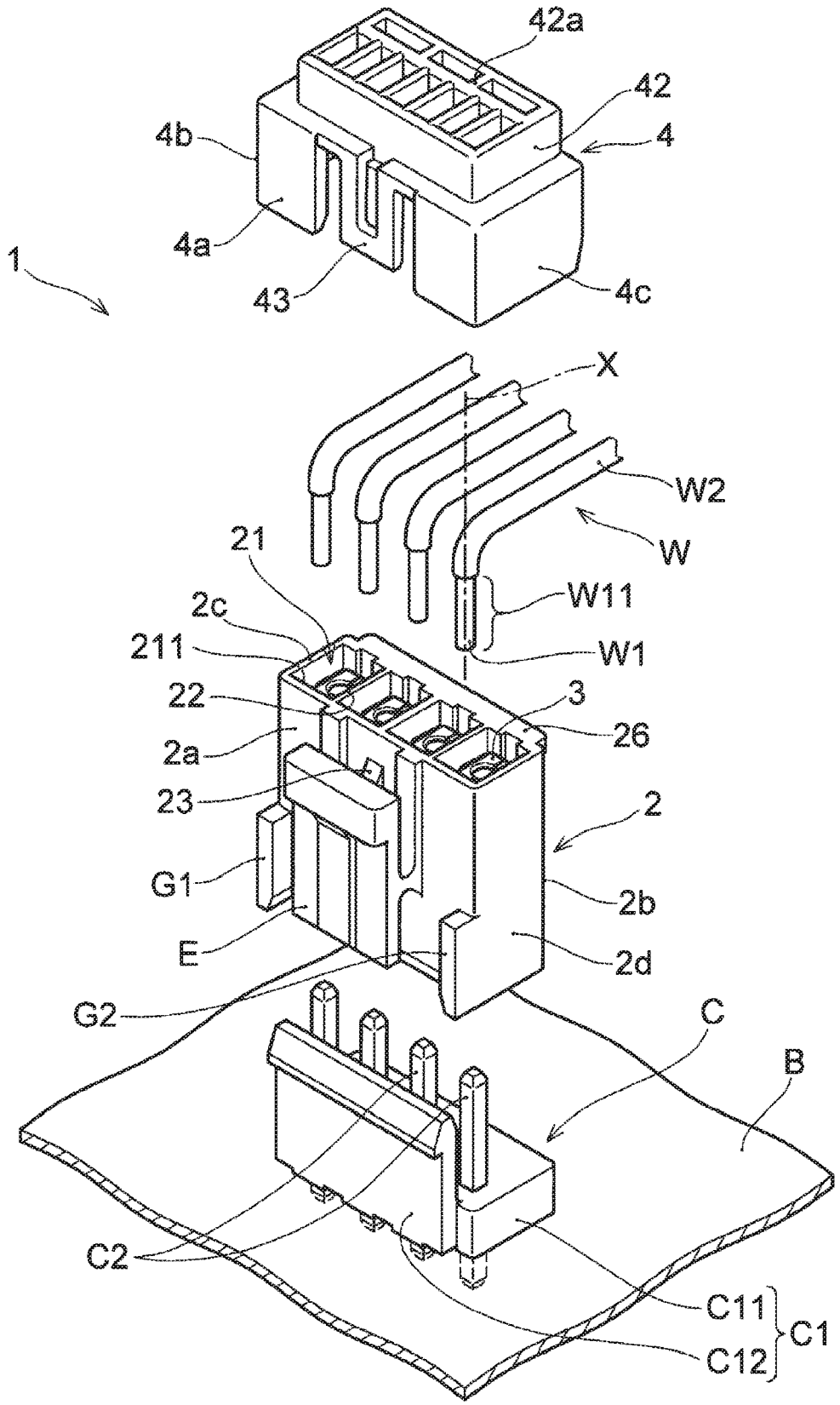
FIG. 1 shows an exploded perspective view of an electrical connector according to one Embodiment of the present invention, and a counterpart connector being connected to a substrate.
Figure 2:
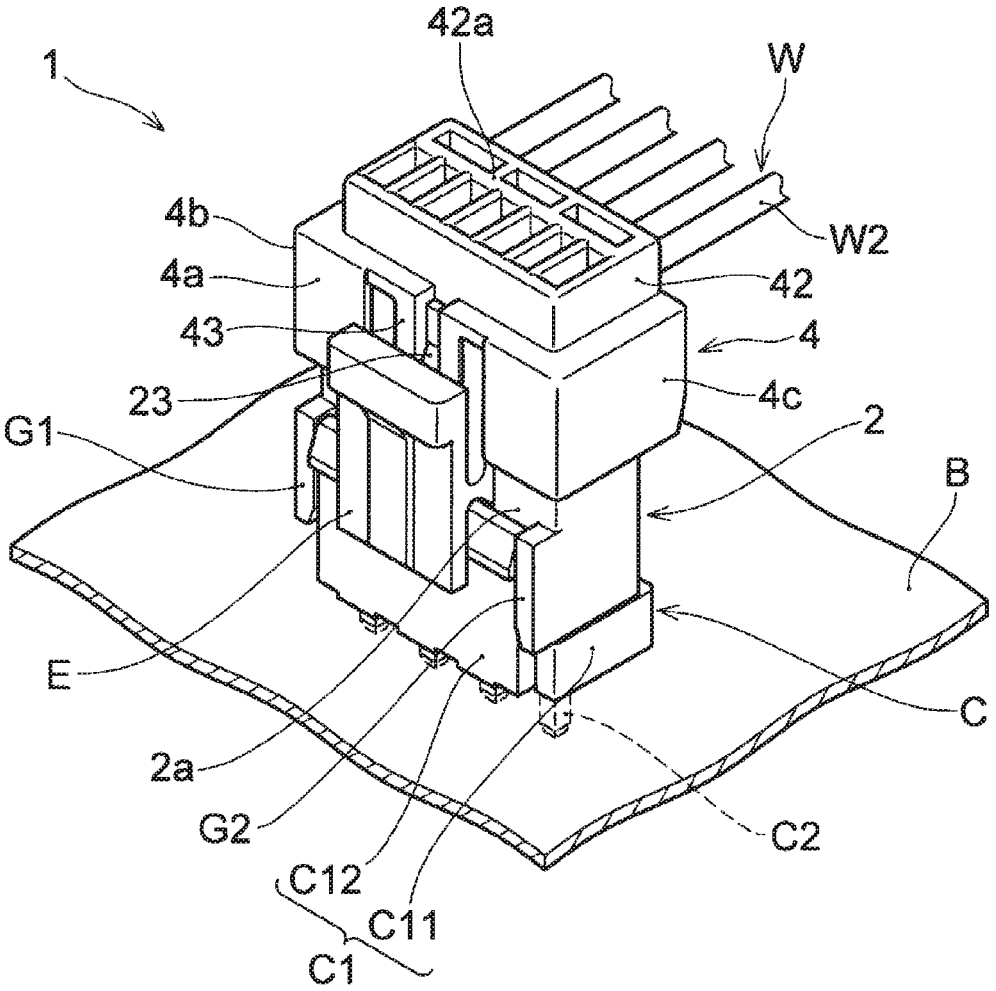
FIG. 2 shows a perspective view in which the electrical connector in FIG. 1 is being connected to the counterpart connector.

As shown in FIGS. 1 and 2, an electrical connector 1 electrically connects a single wire W and a counterpart connector C. In the Embodiment, the electrical connector 1, to which a plurality of single wires W are connected, is fitted to the counterpart connector C to electrically connect the electrical connector 1 to the counterpart connector C. In the specification, the single wire W refers to an electric wire having a single conductor (one single conductor, not a stranded wire; a core wire) W1 and a coating W2 to coat the outer periphery of the conductor W1. At a tip part W11 of the single wire W, which is a part to be connected to a terminal 3 of the electrical connector 1 to be described below, the conductor W1 is being exposed with the coating W2 being removed as shown in FIG. 1.

In the Embodiment, as shown in FIG. 2, the electrical connector 1 is connected to a substrate B via the counterpart connector C. In the Embodiment, the electrical connector 1 and the counterpart connector C are shown as connectors for substrate. However, the electrical connector and the counterpart connector are construed to be not limited to the connectors for substrate. The electrical connector and the counterpart connector may be connectors for different uses, such as wire-to-wire connectors. In the Embodiment, the electrical connector 1 is a female connector and the counterpart connector is a male connector. However, the electrical connector may be a male connector and the counterpart connector may be a female connector. While details of the electrical connector 1 will be described below, as shown in FIG. 1, the electrical connector 1 comprises a housing 2, the terminal 3, and a holding member 4.

The counterpart connector C is a connector to be connected to the electrical connector 1. In the Embodiment, the counterpart connector C is mounted to the substrate B on which a circuit pattern (not shown) is formed. The electrical connector 1 is fitted and connected to the counterpart connector C in a direction being substantially perpendicular to the substrate B. It should be noted that the electrical connector 1 may be fitted and connected to the counterpart connector C in a direction being substantially parallel to the substrate B. In the specification, a direction in which the electrical connector 1 is fitted to and removed from the counterpart connector C is referred to as a fitting direction. Further, regarding each member constituting electrical connector 1 or counterpart connector C, a side in the fitting direction in which the electrical connector 1 moves when the electrical connector 1 is fitted to the counterpart connector C is referred to as a fitting side. Further, a side in the fitting direction in which the electrical connector 1 moves when the electrical connector 1 is removed from the counterpart connector C is referred to as a removal side. The counterpart connector C may be a connector having an electric wire and not being mounted to the substrate B.

As shown in FIG. 1, the counterpart connector C comprises a base part C1 to be connected to the housing 2 of the electrical connector 1, and a plurality of counterpart terminals C2 being provided in the base part C1.

The base part C1 has the counterpart terminal C2 and is to be connected to the housing 2 of the electrical connector 1. For example, the base part C1 is formed by a resin material having insulation properties. The shape and structure of the base part C1 are construed to be not particularly limited and may be appropriately changed in accordance with the uses of the connector to be used. In the Embodiment, the base part C1 is mounted to the substrate B, and supports a plurality of (four) counterpart terminals C2 such that they extend in a direction being perpendicular to the substrate B. The base part C1 has a terminal block C11 into which the counterpart terminals C2 are inserted and a counterpart engaging piece C12 extending from the terminal block C11 in a direction being substantially perpendicular to the substrate B. The terminal block C11 is provided on the surface of the substrate B and formed in a substantially rectangular parallelepiped shape. The counterpart engaging piece C12 is formed in a plate shape and has, at the free end thereof, a claw to be engaged with a housing engaging piece E of the housing 2 to be described below.

The counterpart terminal C2 is a terminal to be connected to the terminal 3 of the electrical connector 1. The terminal 3 of the electrical connector 1, and the counterpart terminal C2 are connected to electrically connect the electrical connector 1 and the counterpart connector C. The shape and structure of the counterpart terminal C2 are construed to be not particularly limited as long as the counterpart terminal C2 may be connected to the terminal 3 of the electrical connector 1 to electrically connect the electrical connector 1 and the counterpart connector C. The shape and structure of the counterpart terminal C2 may be appropriately changed in accordance with the shape of the terminal 3 of the electrical connector 1. In the Embodiment, the counterpart terminal C2 is a pin-shaped terminal formed by a material having electrically conductive properties. The counterpart terminal C2 extends in a direction being substantially perpendicular to the substrate B and is provided to penetrate through the terminal block C11 and the substrate B. One end of the counterpart terminal C2 is inserted into the terminal 3 of the electrical connector 1. The counterpart terminal C2 penetrates the substrate B and the other end of the counterpart terminal C2 is connected to the rear surface of the substrate B by soldering. In the Embodiment, four counterpart terminals C2 are provided. However, the number of the counterpart terminals C2 is construed to be not limited and is appropriately changed in accordance with the number of terminals 3 of the electrical connector 1.

The housing 2 of the electrical connector 1 is connected to the counterpart connector C. The housing 2 is formed by a resin material having insulation properties, for example. As shown in FIG. 1 and FIGS. 3-5, the housing 2 has a housing part 21 to house the terminal 3, and the single wire W is connected to the terminal 3 provided in the housing part 21. The housing part 21 of the housing 2 has a first opening 211, into which the single wire W is inserted toward the terminal 3, and a second opening 212, into which the counterpart terminal C2 of the counterpart connector C is inserted toward the terminal 3 (see FIGS. 3-5). In the Embodiment, the first opening 211 and the second opening 212 are opposed to each other in a direction in which the electrical connector 1 is fitted to the counterpart connector C (upward-downward direction in FIG. 1).

The shape and structure of the housing 2 are construed to be not particularly limited and are appropriately changed in accordance with the uses in which the electrical connector 1 is used or a subject to which the electrical connector 1 is mounted. In the Embodiment, the housing 2 is formed in a substantially rectangular parallelepiped shape, and is configured such that a plurality of (four) terminals 3 may be housed therein. Specifically, the plurality of housing parts 21 are arranged in a row and are partitioned by a partition wall 22, and the terminals 3 housed in the plurality of housing parts 21 are mutually separated. The housing 2 has a first side face 2*a* and a second side face 2*b* opposing each other, and a third side face 2*c* and a fourth side face 2*d*, the third side face 2*c* and the fourth side face 2*d* to mutually connect the first side face 2*a* and the second side face 2*b*. In the Embodiment, the first side face 2*a* and the second side face 2*b* are extending in a direction in which the plurality of housing parts 21 are arranged in a row.

The first side face 2*a* has a housing engaging piece E to engage with the counterpart engaging piece C12 of the counterpart connector C. When the electrical connector 1 is connected to the counterpart connector C, the housing engaging piece E engages with the counterpart engaging piece C12 to prevent coming off of the electrical connector 1. The housing engaging piece E has a claw on the fitting side (the lower side in FIG. 3) in the fitting direction of the housing 2. This claw of the housing engaging piece E engages with the claw of the counterpart engaging piece C12. The housing engaging piece E is formed in a plate shape, is connected to the first side face 2*a* of the housing 2 in a central portion in the fitting direction, and is configured to be swingable. In this way, when one end part of the housing engaging piece E, which is provided at a removal side (the upper side in FIG. 1) in the fitting direction, is pressed toward the first side face 2*a*, engagement between the claw of the housing engaging piece E and the claw of the counterpart engaging piece C12 is released to remove the electrical connector 1 from the counterpart connector C.

Moreover, as shown in FIG. 1, the first side face 2*a* has a pair of guiding parts G1 and G2 being arranged in separation at an interval being slightly greater than the width of the counterpart engaging piece C12 at both ends of the first side face 2*a* in the width direction (the direction in which the plurality of housing parts 21 are arranged in a row. Hereinafter referred to as merely the width direction of the housing 2). At the time of connecting the electrical connector 1 to the counterpart connector C, the counterpart engaging piece C12 may be guided by the pair of guiding parts G1 and G2. Therefore, the electrical connector 1 moves stably relative to the counterpart connector C.

Figure 5:
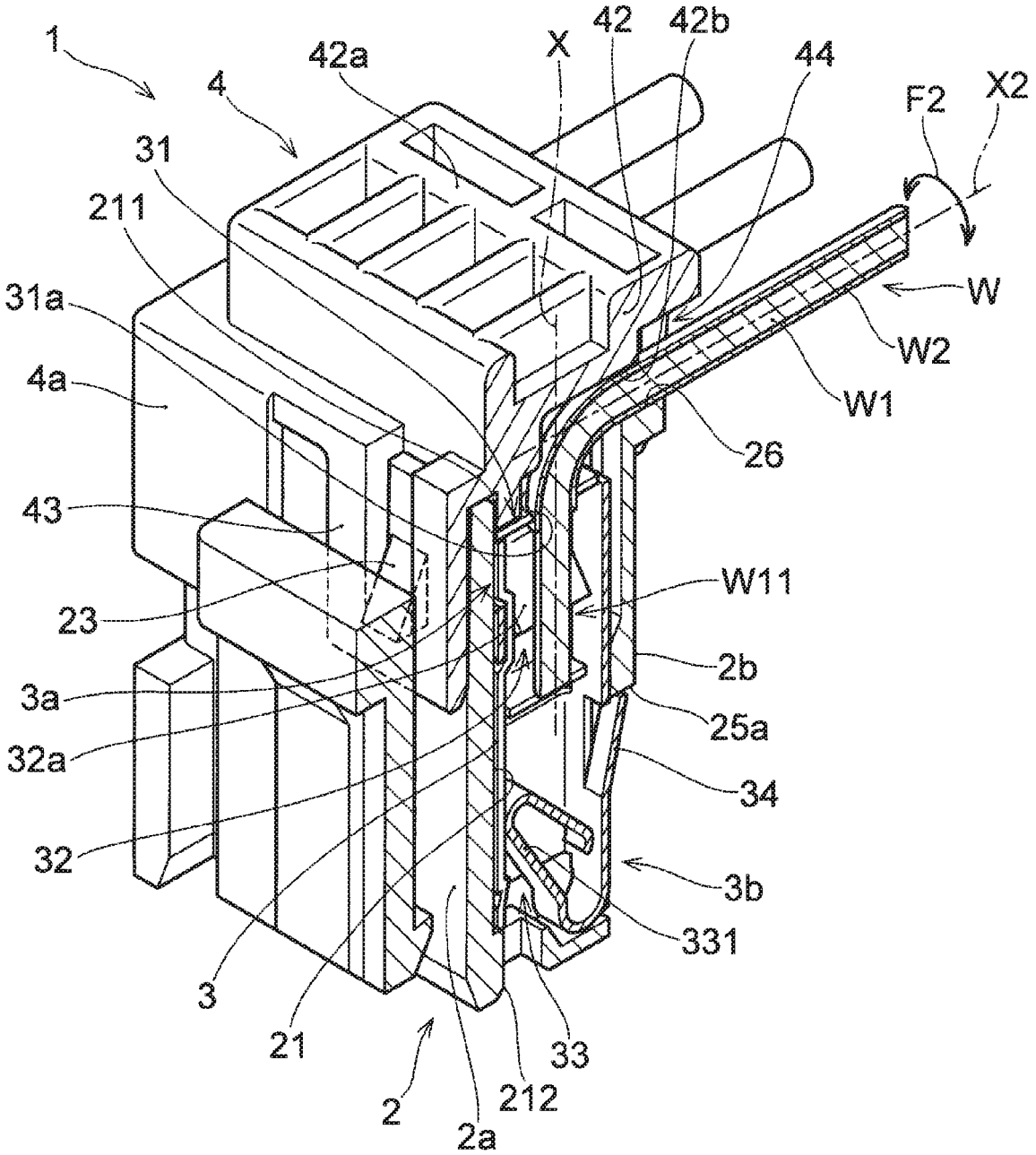
FIG. 5 shows a perspective view in which the cross section in FIG. 4 is viewed from a different angle.

Furthermore, as shown in FIGS. 1 and 5, the first side face 2*a* has an engaged part (a second engaged part) 23, with which an engaging part (a second engaging part 43) of the holding member 4 described below engages. The engaged part 23 has a tapered face being inclined such that the height thereof from the surface of the first side face 2*a* increases toward the fitting side in the fitting direction and a vertical face extending in a direction being substantially perpendicular to the first side face 2*a*. The vertical face is positioned at an end of the engaged part 23 at a fitting side in the fitting direction. In this way, when the holding member 4 described below is fitted to the housing 2, coming off of the holding member 4 from the housing 2 is suppressed.

Figure 3:
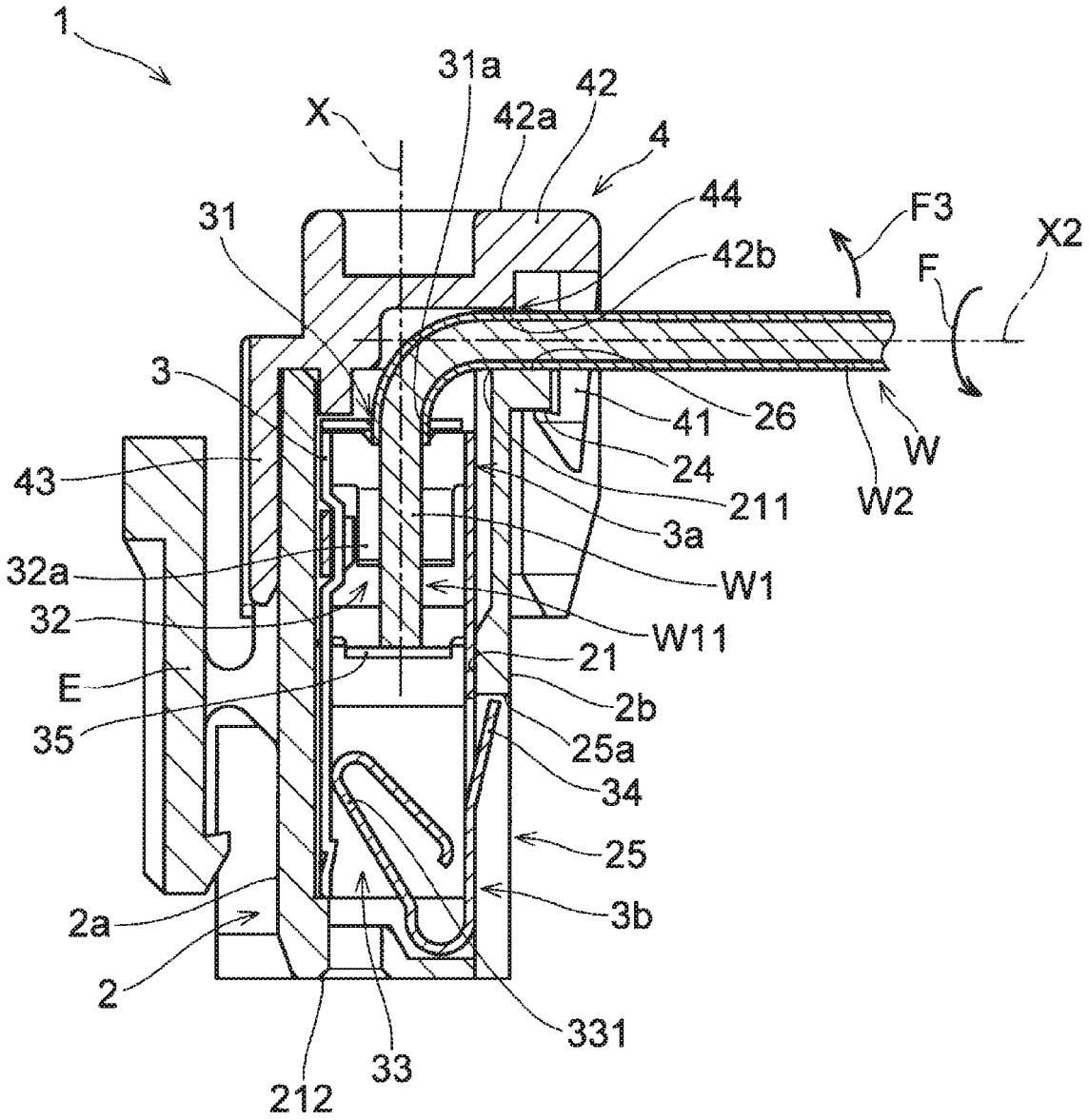
FIG. 3 shows a cross-sectional view being cut a single wire along the longitudinal direction with the single wire being connected to the electrical connector.
Figure 4:
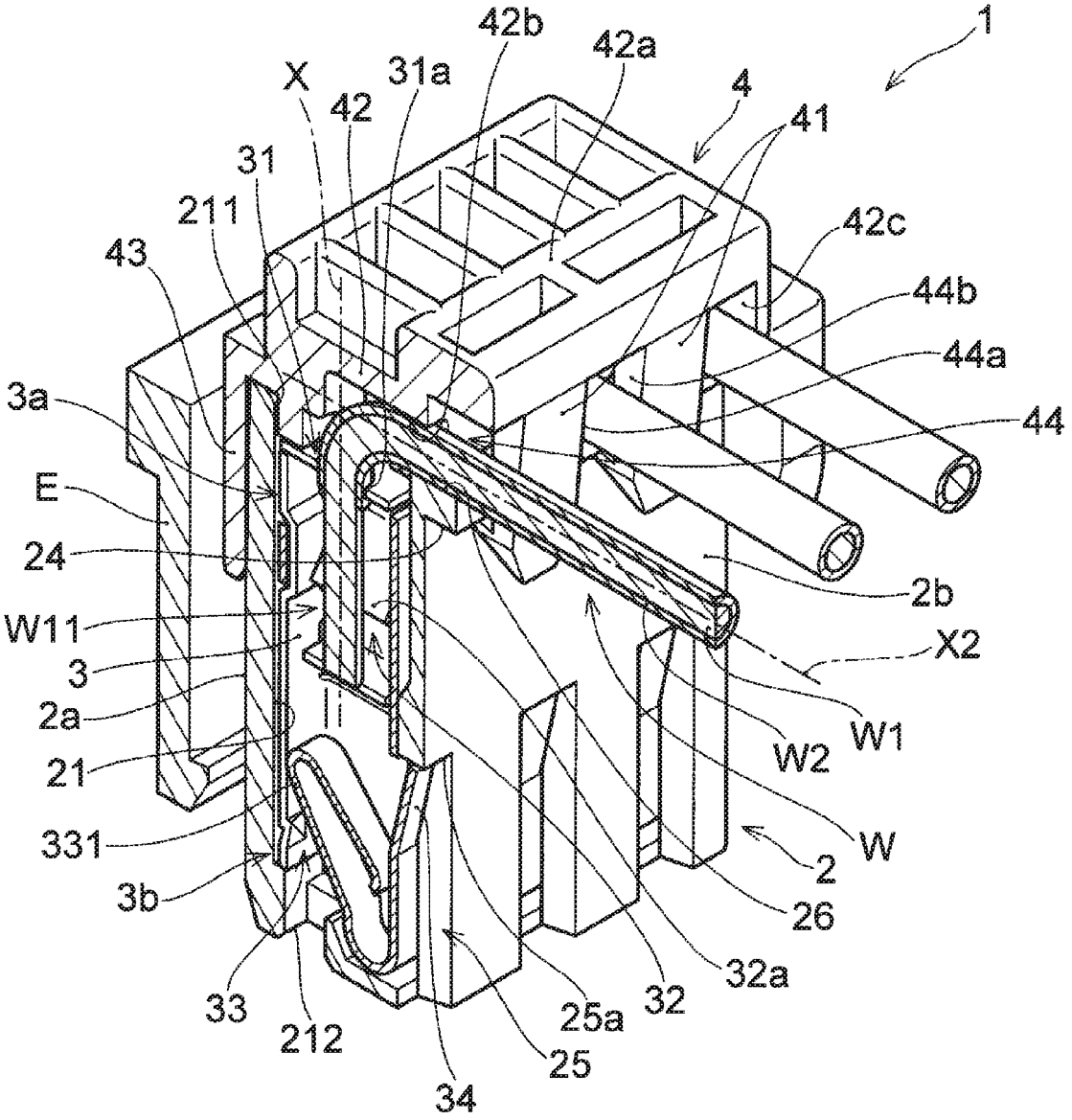
FIG. 4 shows a perspective view being cut by the same cross section as in FIG. 3.

Moreover, as shown in FIGS. 3-5, the second side face 2*b* opposing the first side face 2*a* has an engaged part (a first engaged part) 24 projecting from the second side face 2*b* in proximity to an end part of the second side face 2*b* at a removal side in the fitting direction. An engaging part (a first engaging part 41) of the holding member 4 described below engages with the engaged part 24, and when the holding member 4 is fitted to the housing 2, coming off of the holding member 4 is suppressed.

The terminal 3 is provided in the housing 2, to which the single wire W and the counterpart terminal C2 are connected. The terminal 3 is formed of an electrically conductive material, and when the single wire W and the counterpart terminal C2 are connected, the terminal 3 is electrically connected to the single wire W and to the counterpart terminal C2. The terminal 3 is housed in the housing part 21 of the housing 2. In the Embodiment, the terminal 3 is formed by bending one sheet of metal plate being punched or cut, for example. The terminal 3 is inserted into the housing part 21 of the housing 2 and is mounted to the housing part 21. Specifically, the terminal 3 is formed into a substantially rectangular parallelepiped shape by bending the metal plate. The terminal 3 is inserted and fixed to the housing part 21 being elongated in the fitting direction and having a substantially rectangular shape in the cross section being cut perpendicular to the fitting direction. As shown in FIGS. 3-5, the terminal 3 has a locking piece 34, being in a leaf spring shape, on one of the side faces. The locking piece 34 deforms toward the inside at the time the terminal 3 is inserted into the housing part 21 of the housing 2. When the terminal 3 reaches a given position in the housing part 21 in the fitting direction, the locking piece 34 engages with a locking part 25*a* being provided at the opening edge of an opening 25 being formed on a side face (the second side face 2*b*) of the housing 2. Accordingly, coming off of the terminal 3 from the housing 2 is prevented. It should be noted that the manner to form the terminal 3 and the manner to assemble the terminal 3 into the housing 2 are construed to be not particularly limited.

As shown in FIGS. 3-6, the terminal 3 has a single wire inserting part 31 having an inserting port 31*a* into which the tip part W11 of the single wire W is inserted, a single wire connecting part 32 to which the tip part W11 of the single wire W is electrically connected, and a counterpart terminal connecting part 33 being electrically connected to the counterpart terminal C2 of the counterpart connector C.

The single wire inserting part 31 is a part into which the tip part W11 of the single wire W is inserted. The single wire inserting part 31 is provided at a first end part 3*a* of the terminal 3 and is positioned in proximity to the first opening 211 of the housing 2. The inserting port 31*a* being formed in the single wire inserting part 31 receives the tip part W11 of the single wire W. In the Embodiment, the inserting port 31*a* is formed in a circular shape having a diameter being slightly greater than that of the single wire W. Therefore, the inserting port 31*a* regulates movement of the single wire W in a direction being perpendicular to the inserting direction at the time of inserting the single wire W into the terminal 3 to make it easier to insert the single wire W thereinto. The shape and structure of the inserting part 31*a* are construed to be not particularly limited as long as the single wire W may be inserted thereto toward the single wire connecting part 32.

The single wire connecting part 32 is a part to be electrically connected to the tip part W11 of the single wire W being inserted into the single wire inserting part 31. The single wire connecting part 32 is preferably configured to hold the single wire W so as to maintain the contact with the tip part W11 of the single wire W. The structure of the single wire connecting part 32 is construed to be not limited to the structure shown as long as the single wire W may be connected thereto. In the Embodiment, the single wire connecting part 32 comprises a pair of contact spring parts 32*a* and 32*b* to pinch the tip part W11 of the single wire W from both sides of the tip part W11.

Figure 6:
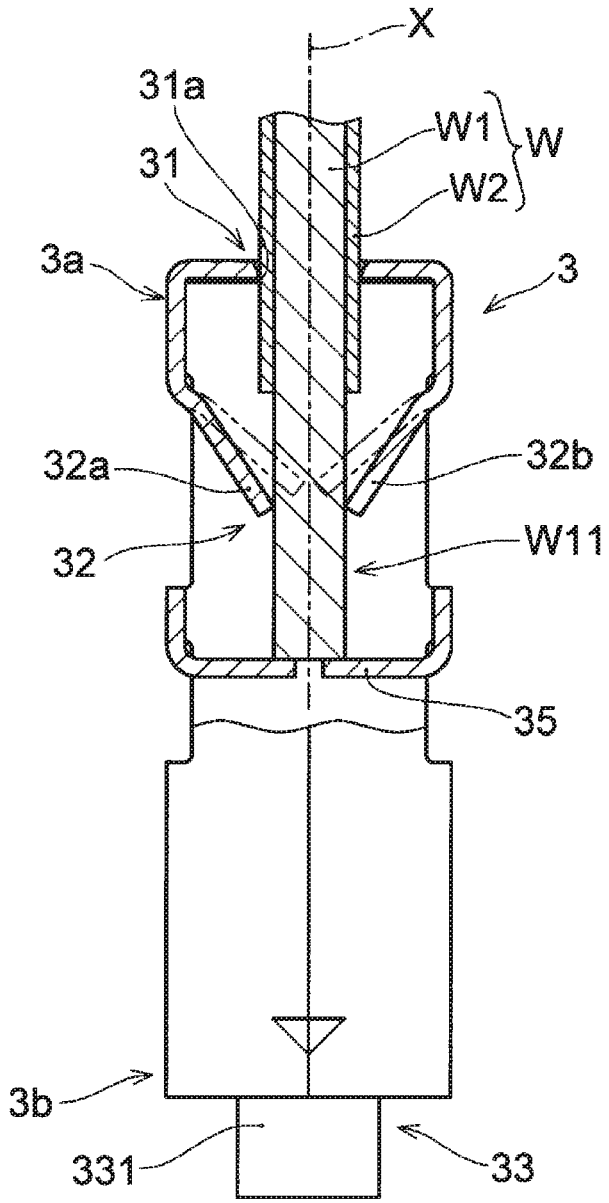
FIG. 6 shows a partial cross-sectional view of a terminal with the single wire being connected thereto.

The pair of contact spring parts 32*a* and 32*b* pinches the single wire W to electrically connect the single wire W and the terminal 3. The pair of contact spring parts 32*a* and 32*b* extends inwardly from each of side faces of the terminal 3 in an inclined manner such that the contact spring parts 32*a* and 32*b* mutually extend closer to each other. Specifically, the pair of contact spring parts 32*a* and 32*b* extends such that the interval between the contact spring part 32*a* and the contact spring part 32*b* decreases as it proceeds in the inserting direction of the single wire W. The pair of contact spring parts 32*a* and 32*b* is formed so as to be bent inwardly relative to the side face of the terminal 3 and functions as leaf springs. The interval between the tips of the contact spring parts 32*a* and 32*b* before the single wire W is inserted is less than the diameter of the single wire W (see the two-dot chain line in FIG. 6). When the single wire W is inserted, the interval between the tips of the contact part 32*a* and the contact part 32*b* increases, and the contact part 32*a* and the contact part 32*b* hold the inserted single wire W between the contact parts 32*a* and 32*b* (see FIG. 6). The pair of contact spring parts 32*a* and 32*b* is provided so as to oppose with each other in the width direction of the housing 2 in the Embodiment. However, it may be provided so as to oppose with each other in the thickness direction of the housing 2. Moreover, as shown in FIG. 6, the terminal 3 has an abutting part 35 to abut against the tip of the single wire W being inserted into the single wire connecting part 32 to regulate the insertion depth of the single wire W. In this way, the single wire W being inserted between the contact spring parts 32*a* and 32*b* while expanding the contact spring parts 32*a* and 32*b* abuts against the abutting part 35 and stops when the single wire W is inserted in a given depth, allowing the single wire W to be positioned.

The counterpart terminal connecting part 33 is a part to which the counterpart terminal C2 of the counterpart connector C is electrically connected. The shape and structure of the counterpart terminal connecting part 33 are construed to be not particularly limited as long as the counterpart terminal connecting part 33 may be electrically connected to the counterpart terminal C2. In the Embodiment, the counterpart terminal connecting part 33 has a spring part 331 formed by bending a metal plate making up the terminal 3 into a spring shape. Specifically, the spring part 331 is formed by being bent at a second end part 3*b* of the terminal 3 to extend in an inclined manner toward the first end part 3*a*, and thereafter, further being bent. The interval between the inner surface of the side face of the terminal 3, and the spring part 331 is less than the width of the counterpart terminal C2. The counterpart terminal C2 is configured to be pinched by the inner surface of the side face of the terminal 3, and the spring part 331 at the time the counterpart terminal C2 is connected to the counterpart terminal connecting part 33.

The holding member 4 is mounted to an end part of the housing 2, the end part being on the side to which the single wire W is connected. The holding member 4 holds the single wire W so that the single wire W extends in a given extending direction. In the Embodiment, the single wire W extends from the holding member 4 so as to be bent with respect to the tip part W11 of the single wire W. In other words, the holding member 4 holds the single wire W such that a part of the single wire W, which extends to the outside of the housing 2, is not on the same axis as the tip part W11 being connected to the single wire connecting part 32 of the terminal 3. While the material of the holding member 4 is construed to be not particularly limited, the holding member 4 may be formed by a resin material having insulation properties, for example.

The holding member 4 is mounted to an end part of the housing 2, the end part being on the side to which the single wire W is connected (an end part in which the first opening 211 is provided), when the single wire W is connected to the terminal 3 and bent. It should be noted that the single wire W may be bent after it is connected to the terminal 3, or may be bent before it is connected to the terminal 3. A method of assembly between the holding member 4 and the housing 2 is construed to be not particularly limited as long as the holding member 4 and the housing 2 may be connected with the single wire W extending in the given extending direction. In the Embodiment, the holding member 4 is mounted to the housing 2 by engaging with the housing 2. Specifically, as shown in FIGS. 3, 4, 7, and 8, the holding member 4 has the first engaging part 41, and the first engaging part 41 engages with the first engaged part 24 being provided on the second side face 2*b* of the housing 2. Therefore, coming off of the holding member 4 from the housing 2 is suppressed. As shown in FIGS. 3-5, the holding member 4 has a base body 42 extending in a direction being perpendicular to the axis X direction of the tip part W11 of the single wire W. The first engaging part 41 extends in the axis X direction of the tip part W11 of the single wire W from the base body 42 so as to engage with the first engaged part 24. The shape and structure of the first engaging part 41 are construed to be not particularly limited. In the Embodiment, the first engaging part 41 has a claw at the tip thereof. When the holding member 4 is pushed toward the housing 2 in the axis X direction of the tip part W1 of the single wire W, the claw of the first engaging part 41 engages with the engaged part 24 (see FIG. 3). In the Embodiment, the plurality of first engaging parts 41 are provided in a manner such that they are substantially parallel to one another, and the single wire W being bent extends in a given extending direction between the plurality of first engaging parts 41.

Figure 7:
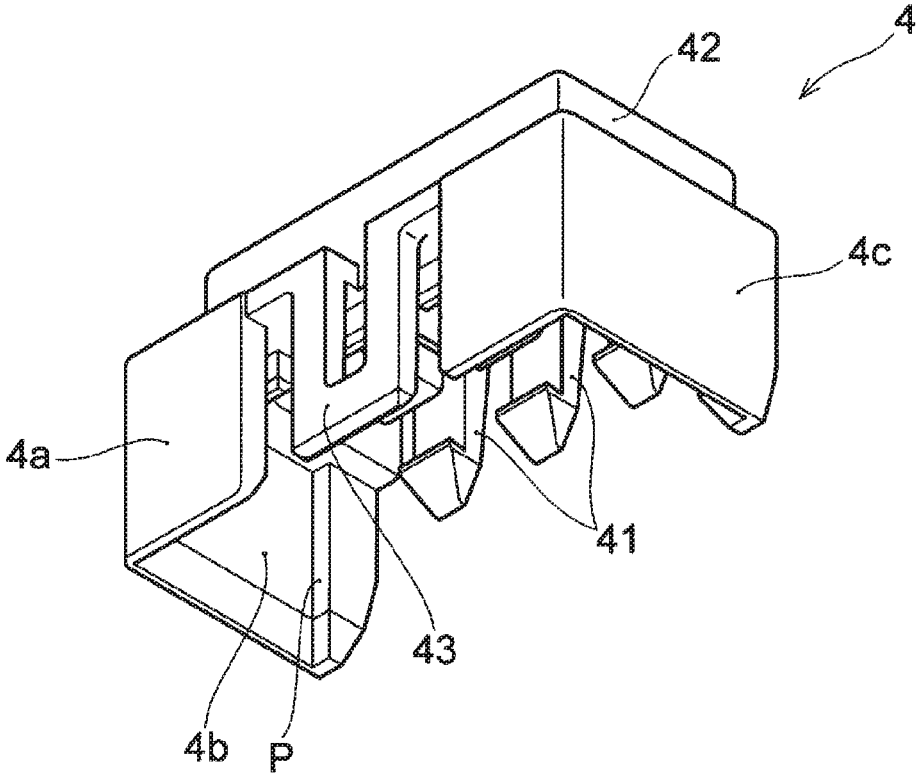
FIG. 7 shows a perspective view of a holding member.
Figure 8:
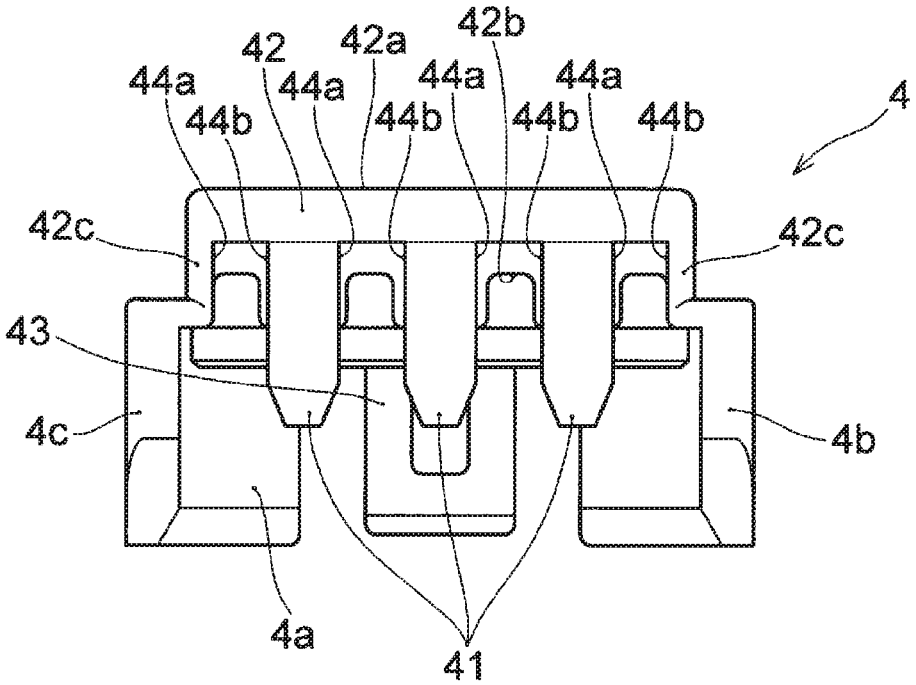
FIG. 8 shows a side view in which the holding member is viewed from the first engaging part side.
Figure 9:
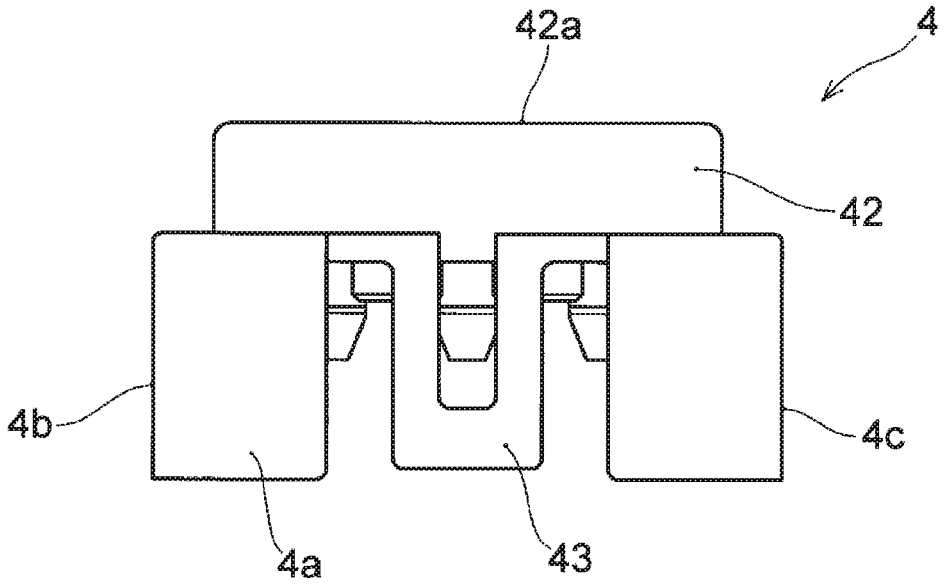
FIG. 9 shows a side view in which the holding member is viewed from the second engaging part side.

Moreover, as shown in FIGS. 5, 7, and 9, the holding member 4 has the second engaging part 43. The second engaging part 43 engages with the second engaged part 23 being provided on the first side face 2*a* of the housing 2. Therefore, coming off of the holding member 4 from the housing 2 is suppressed. The second engaging part 43 extends from the base body 42 in the axis X direction of the tip part W11 of the single wire W so as to engage with the second engaged part 23. The shape and structure of the second engaging part 43 are construed to be not particularly limited. In the Embodiment, the second engaging part 43 is like a leaf spring and is formed in a substantially U-shape. When the holding member 4 is pushed toward the housing 2 in the axis X direction of the tip part W11 of the single wire W, the tip part of the second engaging part 43 climbs over the inclined face of the second engaged part 23. And then, the second engaging part 43 engages with the vertical face of the second engaged part 23 (see FIG. 5).

In the Embodiment, as shown in FIGS. 3-5 and 9, the holding member 4 has a pressing face 42*a* extending in a direction being perpendicular to the axis X direction of the tip part W11 of the single wire W. The holding member 4 having the pressing face 42*a* makes it easy to apply a force to the holding member 4 at the time of fitting the holding member 4 to the housing 2. Therefore, it is possible to easily mount the holding member 4 to the housing 2. Moreover, by pressing the pressing face 42*a* at the time of connecting the electrical connector 1 to the counterpart connector C after the holding member 4 is mounted to the housing 2, it is possible to prevent that a force to further bend the single wire W is applied to the curved single wire W. The pressing face 42*a* may formed flat in its entirety, or, as in the Embodiment, the wall thickness thereof may be partially reduced as long as an area to press with a finger is secured.

In the Embodiment, the holding member 4 has, besides the first engaging part 41 and the second engaging part 43, side walls being provided so as to cover the end part of the housing 2 with the side walls opposing the three outer surfaces (the first side face 2*a*, the third side face 2*c*, and the fourth side face 2*d*) of the housing 2 when the holding member 4 is mounted to the housing 2 (see FIG. 7). In the Embodiment, the side walls include a first side wall 4*a* opposing the first side face 2*a*, a second side wall 4*b* opposing the third side face 2*c*, and a third side wall 4*c* opposing the fourth side face 2*d*. The second side wall 4*b* and the third side wall 4*c* oppose each other. The second side wall 4*b* has a projecting part P (see FIG. 7) projecting toward the third side wall 4*c* so as to engage with the second side face 2*b* of the housing 2. In the same manner, the third side wall 4*c* has a projecting part projecting toward the second side wall 4*b* so as to engage with the second side face 2*b* of the housing 2. As described above, the first side wall 4*a*, the second side wall 4*b*, and the third side wall 4*c* of the holding member 4 oppose the three outer surfaces (the first side face 2*a*, the third side face 2*c*, and the fourth side face 2*d*) of the housing 2, and the projecting parts P projecting from the second side wall 4*b* and the third side wall 4*c* engage with the second side face 2*b* of the housing 2. This makes it possible to more stably mount the holding member 4 to the housing 2. The second engaging part 43 is provided in a central portion of the first side wall 4*a*.

As shown in FIGS. 3-5, the holding member 4 has a leading-out part 44 to lead out the single wire W from the inside of the housing 2 to the outside of the housing 2. The leading-out part 44 is configured to lead out the single wire W being bent and extending in a given extending direction so as to cross the axis X direction of the tip part W11 of the single wire W connected to the single wire connecting part 32. In the Embodiment, the given extending direction of the single wire W is a direction being substantially orthogonal to the tip part W1 of the single wire W. However, it suffices that the extending direction of the single wire W be not on an extension line of the tip part W11. While the angle being formed by the axis X of the tip part W11 of the single wire W and the axis X2 of a portion passing through the leading-out part 44 of the single wire W (see FIGS. 3-5) is construed to be not particularly limited, it is preferably between 80 and 100 degrees, and more preferably between 85 and 95 degrees, for example.

The leading-out part 44 is a part to guide the single wire W such that the single wire W extends in a bent state with respect to the tip part W11. In the Embodiment, the dimension of the leading-out part 44 in the axis X direction is defined by a bottom face 42*b* of the base body 42 of the holding member 4, and an upper end face 26 of the second side face 2*b* of the housing 2. While details will be described below, in the Embodiment, the leading-out part 44 has a pair of wall parts 44*a* and 44*b* to abut against the single wire W so that the tip part W11 of the single wire W does not rotate around the axis X of the tip part W11. The pair of wall parts 44*a* and 44*b* is separated from each other at a distance corresponding to the diameter of the single wire W along the width direction of the housing 2. In the Embodiment, the pair of wall parts 44*a* and 44*b* is made up by the mutually opposing side edges of the pair of the first engaging parts 41 neighboring each other. In the single wire W being provided on the outermost side, the side edge of the first engaging part 41, and a side wall 42*c* of the base body 42 opposing the side edge of the first engaging part 41 (see FIGS. 4 and 8) make up the pair of wall parts 44*a* and 44*b*. While the leading-out part 44 is opened at a side of the second side face 2*b* of the housing 2 in the Embodiment, the leading-out part may be opened at a side of the first side face 2*a* of the housing 2, may be opened at a side of the third side face 2*c* of the housing 2 or at a side of the fourth side face 2*d* of the housing 2, or may be opened at a part or all of the sides of the above-mentioned side faces.

Next, the effect of the Embodiment is described.

In the Embodiment, the holding member 4 has the leading-out part 44, and the leading-out part 44 is configured to lead out the single wire W being bent and extending in a given extending direction so as to cross the axis X direction of the tip part W11 of the single wire W. In this way, the single wire W is mounted such that the axis X of the tip part W11 of the single wire W and the axis X2 of a leading-out portion of the single wire W being led out from the leading-out part 44 cross each other when the single wire W is connected to the electrical connector 1. Therefore, even in a case that a rotational force F (see FIG. 3) is applied around the axis X2 to the single wire W being led out to the outside of the housing 2, for example, a force to rotate around the axis X of the tip part W11 of the single wire W, which causes coming off of the tip part W11 of the single wire W from the single wire connecting part 32, is not generated on the tip part W11 of the single wire W. Therefore, coming off of the tip part W11 of the single wire W from the single wire connecting part 32 is suppressed.

Moreover, in the Embodiment, the leading-out part 44 has the pair of wall parts 44*a* and 44*b*, and the single wire W passing through the leading-out part 44 abuts against the pair of wall parts 44*a* and 44*b*. Therefore, the single wire W abuts against the pair of wall parts 44*a* and 44*b* even in a case that a force F2 to rotate the single wire W around the axis X of the tip part W11 of the single wire W in the horizontal direction is applied, as shown in FIG. 5, to a portion being led out from the leading-out part 44 of the single wire W. Therefore, the rotational force to rotate the single wire W around the axis X is not transmitted to the tip part W11 of the single wire W by the pair of wall parts 44*a*, 44*b* and the single wire W abutting against each other. Thus, in the tip part W11 of the single wire W, a rotational force to rotate the single wire W around the axis X of the tip part W11, which causes coming off of the single wire W from the single wire connecting part 32, is not generated. Therefore, coming off of the tip W11 of the single wire W from the single wire connecting portion 32 is suppressed.

Furthermore, in the Embodiment, the first engaging part 41 of the holding member 4 is provided at a position neighboring the leading-out part 44. Since the first engaging part 41 is provided at the position neighboring the leading-out part 44, even in a case that a force F3 is applied to the single wire W in a direction such that the holding member 4 is removed from the housing 2 as shown with an arrow F3 in FIG. 3, for example, the force applied to the holding member 4 from the single wire W is supported by engagement of the first engaging part 41 with the first engaged part 24. Therefore, coming off of the holding member 4 from the housing 2 is efficiently suppressed.

Next, variations of the Embodiment are described.

Figure 10:
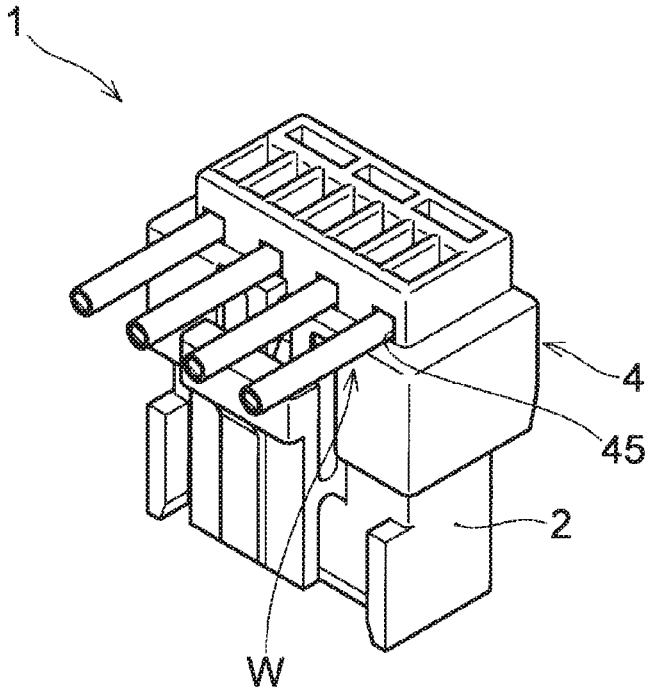
FIG. 10 shows a perspective view of a variation of the electrical connector in which a second leading-out part is provided.
Figure 11:
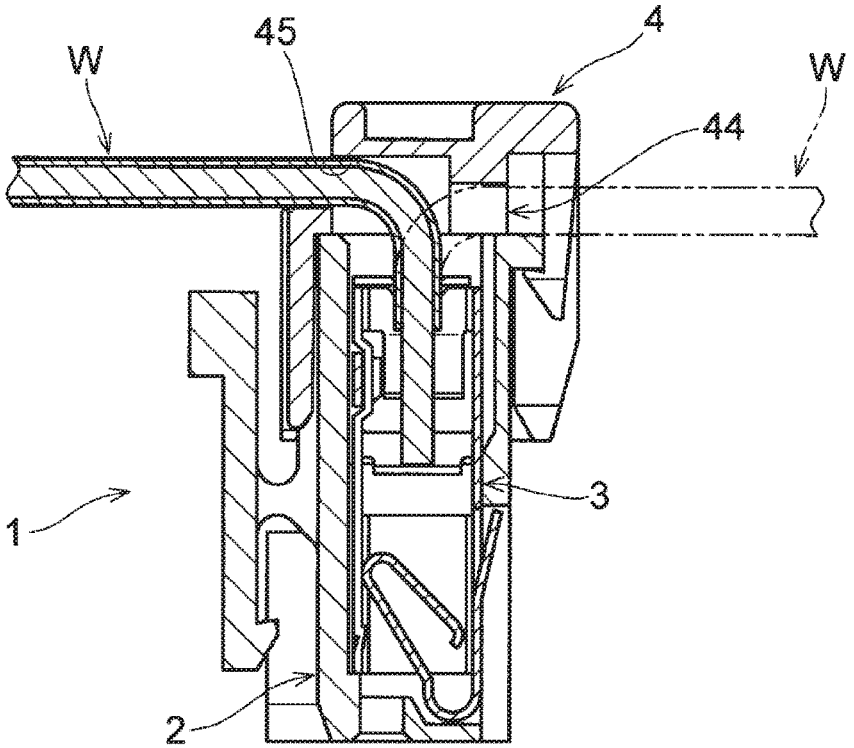
FIG. 11 shows a cross-sectional view of the variation of the electrical connector in which the second leading-out part is provided.

While the leading-out part 44 is configured such that the plurality of single wires W extend in the same direction in the above-described Embodiment, as shown in FIGS. 10 and 11, for example, the holding member 4 may have a second leading-out part 45, and in a case that the single wire W is bent in a second direction other than the extending direction (see the two-dot chain line in FIG. 11) of the single wire W being led out in the leading-out part 44, the second leading-out part 45 is configured to lead out the single wire W in the second direction. The leading-out part 44 is provided on the side being opposite to the side at which the second leading-out part 45 is provided.

The second leading-out part 45 is shown as a partitioned rectangular through hole in FIG. 10. In this case, the single wire W may be passed through the second leading-out part 45 before the holding member 4 is assembled into the housing 2. The second leading-out part 45 may be similarly configured as the leading-out part 44 rather than being configured as a through hole in which the surrounding thereof is partitioned.

Figure 12:
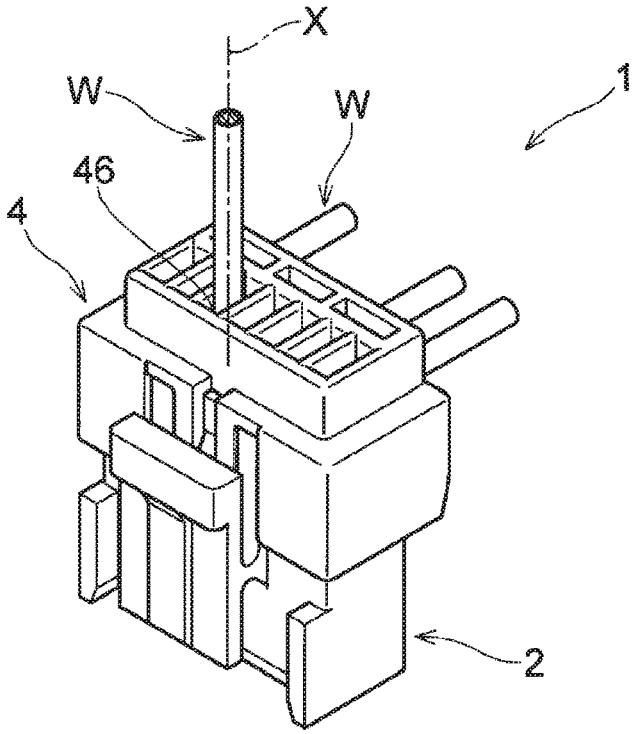
FIG. 12 shows a perspective view of a variation of the electrical connector in which a third leading-out part is provided.
Figure 13:
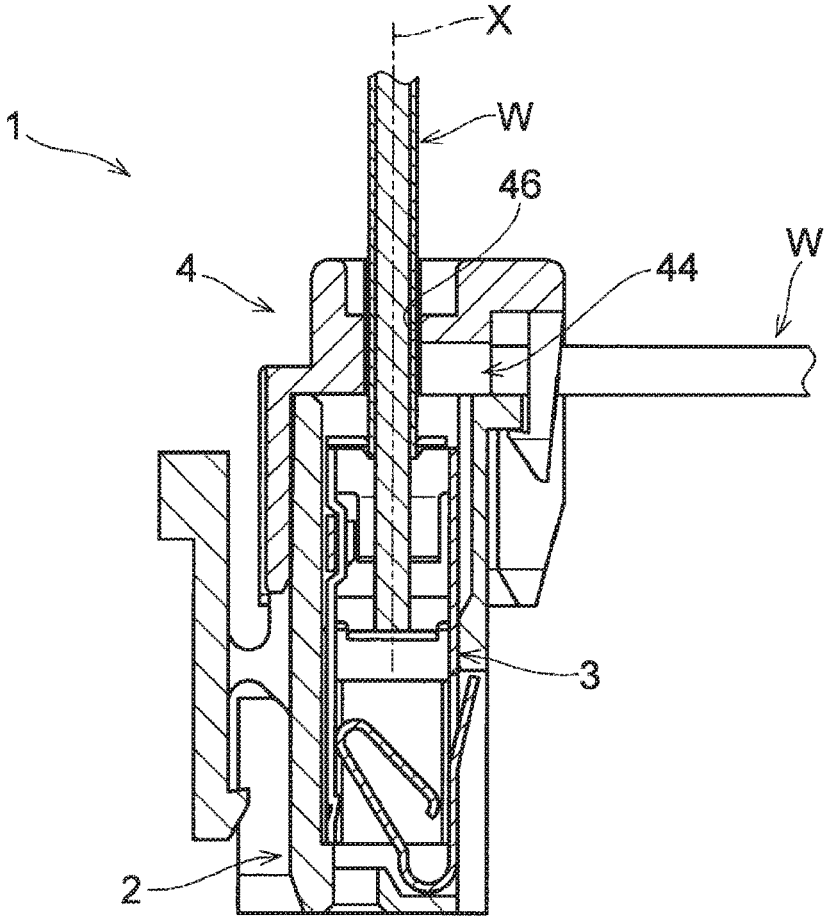
FIG. 13 shows a cross-sectional view of the variation of the electrical connector in which the third leading-out part is provided.

Moreover, as shown in FIGS. 12 and 13, the holding member 4 may further have a third leading-out part 46, and in a case that the single wire W extends along the axis X direction of the tip part W11 of the single wire W, the third leading-out part 46 is configured to lead out the single wire in the axis X direction of the tip part W11 of the single wire W. For example, when the number of single wires W to be connected to the electrical connector 1 increases, there may be a necessity to extend the single wires W in various directions. In such a case, the third leading-out part 46 being provided makes it possible to increase the selectivity of the extending direction of the single wire W.

Figure 14:
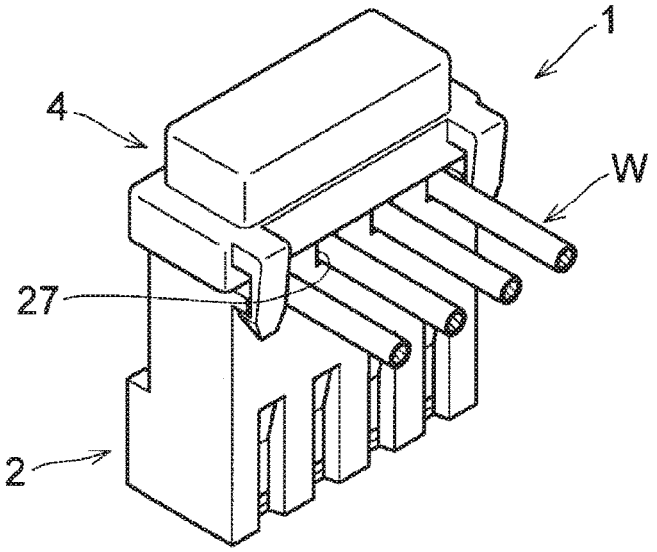
FIG. 14 schematically shows a view of the electrical connector in which a leading-out part is provided in a housing.

Furthermore, as shown in a schematic view in FIG. 14, a leading-out part 27 may be provided in the housing 2. For example, the leading-out part 27 may be formed by forming a notch part, which may house the single wire W, at an edge part at which the first opening 211 of the housing 2 is provided. Even in a case that the leading-out part 27 is formed in the housing 2, the same advantage as that of forming the leading-out part 44 in the holding member 4 may be obtained. In addition to the leading-out part 27, the second leading-out part (see FIGS. 10 and 11) may also be formed in the housing 2.

1 Electrical connector
2 Housing
2*a* First side face
2*b* Second side face
2*c* Third side face
2*d* Fourth side face
21 Housing part
211 First opening
212 Second opening
22 Partition wall
23 Second engaged part
24 First engaged part
25 Opening
25*a* Locking part
26 Upper end face of second side face of housing
3 Terminal
3*a* First end part of terminal
3*b* Second end part of terminal
31 Single wire inserting part
31*a* Inserting port
32 Single wire connecting part
32*a*, 32*b* Contact spring part
33 Counterpart terminal connecting part
331 Spring part
34 Locking piece
35 Abutting part
4 Holding member
4*a* First side wall
4*b* Second side wall
4*c* Third side wall
41 First engaging part
42 Base body
42*a* Pressing face
42*b* Bottom face of base body
42*c* Side wall of base body opposing side edge of first engaging part
43 Second engaging part
44 Leading-out part
44*a*, 44*b* Wall part
45 Second leading-out part
46 Third leading-out part
B Substrate
C Counterpart connector
C1 Base part
C11 Terminal block
C12 Counterpart engaging piece
C2 Counterpart terminal
E Housing engaging piece
G1, G2 Guiding part
P Projecting part
W Single wire
W1 Conductor
W11 Tip part of single wire
W2 Coating
X Axis of tip part of single wire
X2 Axis of portion passing through leading-out part of single wire

What is claimed is:

1. An electrical connector, to which a single wire is to be connected, the electrical connector to be electrically connected to a counterpart connector, and the electrical connector comprising:

a housing;

a terminal to which the single wire is to be connected, the terminal being provided in the housing; and a holding member for holding the single wire in a given extending direction, the holding member being mounted to an end part of the housing, the end part being on a side of the housing at which the single wire is connected, wherein the terminal has a single wire insertion part having an inserting port into which a tip part of the single wire is inserted; a single wire connecting part to be electrically connected to the tip part of the single wire; and a counterpart terminal connecting part to be electrically connected to a counterpart terminal of the counterpart connector;

the holding member and/or the housing has a leading-out part to lead out the single wire from an inside of the housing to an outside of the housing;

the leading-out part is configured to lead out the single wire being bent and extending in the given extending direction so as to cross an axis direction of the tip part of the single wire connected to the single wire connecting part, and wherein the leading-out part has a pair of wall parts to abut against the single wire such that the tip part of the single wire does not rotate around the axis of the tip part.

2. The electrical connector according to claim 1, wherein the single wire connecting part comprises a pair of contact spring parts pinching the tip part of the single wire from both sides of the single wire.

3. The electrical connector according to claim 1, wherein the holding member has an engaging part to engage with an engaged part provided on a side face of the housing, and the engaging part is provided at a position being adjacent to the leading-out part.

4. The electrical connector according to claim 1, wherein the holding member has a pressing face extending in a direction being perpendicular to the axis direction of the tip part of the single wire.

5. The electrical connector according to claim 1, wherein the holding member and/or the housing further has a second leading-out part, and in a case that the single wire is bent in a second direction other than the extending direction of the single wire being led out in the leading-out part, the second leading-out part is configured to lead out the single wire in the second direction.

6. The electrical connector according to claim 1, wherein the holding member further has a third leading-out part, and in a case that the single wire extends along the axis direction of the tip part of the single wire, the third leading-out part is configured to lead out the single wire in the axis direction of the tip part of the single wire.

7. The electrical connector according to claim 1, wherein the holding member has a plurality of engaging parts engaging with an engaged part provided on a side face of the housing, the plurality of engaging parts extending in the axis direction of the tip part of the single wire and parallel to one another, and wherein an edge of one of neighboring engaging parts constitutes one of the pair of wall parts, and an edge of the other of the neighboring engaging parts constitutes the other of the pair of wall parts.

8. The electrical connector according to claim 1, wherein the pair of wall parts is separated from each other at a distance corresponding to a diameter of the single wire.

* * * * *